US009814922B2

(12) United States Patent
Moran et al.

(10) Patent No.: US 9,814,922 B2
(45) Date of Patent: Nov. 14, 2017

(54) WEIGHT SENSING BASE FOR AN ADJUSTABLE DUMBBELL SYSTEM

(71) Applicant: Nautilus, Inc., Vancouver, WA (US)

(72) Inventors: Thomas H. Moran, Portland, OR (US); Edward L. Flick, Brush Prairie, WA (US)

(73) Assignee: NAUTILUS, INC., Vancouver, WA (US)

( * ) Notice: Subject to any disclaimer, the term of this patent is extended or adjusted under 35 U.S.C. 154(b) by 0 days.

(21) Appl. No.: 14/587,642

(22) Filed: Dec. 31, 2014

(65) Prior Publication Data

US 2016/0184623 A1 Jun. 30, 2016

(51) Int. Cl.

| | |
|---|---|
| ***A63B 24/00*** | (2006.01) |
| ***A63B 21/075*** | (2006.01) |
| ***A63B 21/00*** | (2006.01) |
| ***A63B 21/072*** | (2006.01) |

(52) U.S. Cl.

CPC ..... *A63B 21/075* (2013.01); *A63B 21/00065* (2013.01); *A63B 21/0726* (2013.01); *A63B 21/0728* (2013.01); *A63B 24/0087* (2013.01); *A63B 2220/52* (2013.01); *A63B 2220/833* (2013.01); *A63B 2225/50* (2013.01)

(58) Field of Classification Search

CPC . A63B 24/00; A63B 24/0062; A63B 21/0724; A63B 24/0087; A63B 21/075; A63B 21/00065; A63B 21/0726; A63B 21/0728; A63B 2220/52; A63B 2220/833; A63B 2225/50

See application file for complete search history.

(56) References Cited

U.S. PATENT DOCUMENTS

| | | | | |
|---|---|---|---|---|
| 5,210,706 | A | 5/1993 | Nishiyama | |
| 5,857,939 | A | 1/1999 | Kaufman | |
| 6,014,078 | A * | 1/2000 | Rojas | A63B 21/072 340/323 R |
| 6,033,350 | A | 3/2000 | Krull | |
| D422,654 | S | 4/2000 | Chen | |
| 6,099,442 | A | 8/2000 | Krull | |
| 6,261,022 | B1 | 7/2001 | Dalebout et al. | |

(Continued)

FOREIGN PATENT DOCUMENTS

| | | |
|---|---|---|
| CN | 2471358 Y | 1/2002 |
| CN | 201482056 U | 5/2010 |

(Continued)

OTHER PUBLICATIONS

International Search Report and Written Opinion for international application PCT/US15/67328 dated Feb. 26, 2016, 11 pages.

*Primary Examiner* — Glenn Richman
(74) *Attorney, Agent, or Firm* — Dorsey & Whitney LLP

(57) ABSTRACT

In various implementations, an adjustable dumbbell system may include a handle assembly, two or more weight plates, and a base. The weight plates and the handle assembly may be configured such that each weight plate can be selectively coupled to and decoupled from the handle assembly. The base may be configured to support each of the weight plates. The base may include a sensing mechanism that senses a characteristic of the weight plates where the characteristic depends upon which of the weight plates are supported by the base.

27 Claims, 11 Drawing Sheets

(56) References Cited

U.S. PATENT DOCUMENTS 6,322,481 B1 11/2001 Krull
6,402,666 B2 6/2002 Krull
6,416,446 B1 7/2002 Krull
6,540,650 B1 4/2003 Krull
6,629,910 B1 10/2003 Krull
6,632,159 B1 * 10/2003 Slattery ..... A63B 21/078 482/4
6,669,606 B2 12/2003 Krull
6,679,816 B1 1/2004 Krull
6,719,674 B2 4/2004 Krull
6,733,424 B2 5/2004 Krull
6,746,381 B2 6/2004 Krull
6,749,547 B2 6/2004 Krull
6,793,607 B2 9/2004 Neil
D498,272 S 11/2004 Sanford-Schwentke et al.
6,855,097 B2 2/2005 Krull
6,872,173 B2 3/2005 Krull
6,896,645 B1 5/2005 Krull
6,899,661 B1 5/2005 Krull
D508,628 S 8/2005 Crawford et al.
6,949,052 B2 9/2005 Millington et al.
6,974,405 B2 12/2005 Krull
6,997,856 B1 2/2006 Krull
7,060,011 B1 6/2006 Krull
7,066,867 B2 6/2006 Krull
7,077,790 B1 7/2006 Krull
D528,173 S 9/2006 Flick et al.
D528,611 S 9/2006 Flick et al.
7,128,696 B1 10/2006 Krull
7,128,697 B1 10/2006 Krull
7,153,243 B1 12/2006 Krull
D540,405 S 4/2007 Crawford et al.
D540,894 S 4/2007 Crawford et al.
7,264,578 B1 9/2007 Krull
7,291,098 B1 11/2007 Krull
7,300,390 B1 11/2007 Krull
7,387,597 B2 6/2008 Krull
7,455,621 B1 * 11/2008 Anthony ..... A63B 21/0724 482/3
7,470,216 B2 12/2008 Farinelli et al.
D584,086 S 1/2009 Gettle
7,497,813 B1 3/2009 Krull
7,497,814 B1 3/2009 Krull
7,547,268 B1 6/2009 Krull
7,578,771 B1 8/2009 Towley, III et al.
7,588,520 B2 9/2009 Nalley
7,604,577 B2 10/2009 Lin
7,608,021 B1 10/2009 Nalley
7,614,982 B2 11/2009 Crawford et al.
7,614,983 B1 11/2009 Krull
7,621,855 B1 11/2009 Krull
7,625,322 B1 12/2009 Krull
7,648,448 B2 1/2010 Krull
D610,636 S 2/2010 Golesh et al.
7,678,030 B2 3/2010 Savage
D617,854 S 6/2010 Gettle
7,794,359 B1 9/2010 Lannon et al.
7,874,958 B1 1/2011 Ramsey, Sr.
D639,358 S 6/2011 Rauwerdink
D639,359 S 6/2011 Rauwerdink
7,981,012 B1 7/2011 Krull
D643,481 S 8/2011 Rauwerdink
8,002,680 B2 8/2011 Crawford et al.
8,007,415 B1 8/2011 Lundquist
8,038,576 B2 10/2011 Farinelli et al.
8,075,458 B2 12/2011 Nalley
8,105,207 B1 1/2012 Lannon et al.
8,105,209 B2 1/2012 Lannon et al.
8,217,797 B2 7/2012 Ikoyan
8,287,438 B2 10/2012 Krull
8,337,364 B2 12/2012 Ishii et al.
8,747,282 B2 6/2014 Lannon et al.
8,749,380 B2 6/2014 Vock et al.
8,913,134 B2 12/2014 Goree et al.
8,932,188 B2 1/2015 Svenberg
9,126,072 B2 * 9/2015 Watterson ..... A63B 24/0062
2002/0128127 A1 9/2002 Chen
2003/0148862 A1 8/2003 Chen et al.
2005/0065003 A1 3/2005 Klotzki
2005/0227831 A1 10/2005 Mills et al.
2006/0084422 A1 4/2006 Huang et al.
2009/0186748 A1 7/2009 Golesh et al.
2010/0184570 A1 7/2010 Cheng
2010/0304938 A1 12/2010 Olson
2010/0304940 A1 12/2010 Svenberg et al.
2012/0115689 A1 5/2012 Dalebout et al.
2012/0309597 A1 12/2012 Liu
2013/0090212 A1 4/2013 Wang
2013/0171599 A1 7/2013 Bleich et al.
2013/0288859 A1 10/2013 Watterson
2014/0235409 A1 8/2014 Salmon et al.
2014/0243168 A1 8/2014 Razzaq
2014/0248996 A1 9/2014 Adel
2014/0274596 A1 9/2014 Krull
2014/0349820 A1 11/2014 Wang
2016/0107062 A1 * 4/2016 Zimmerman ..... B07C 5/16 700/213
2016/0346617 A1 * 12/2016 Srugo ..... G09B 19/0038

FOREIGN PATENT DOCUMENTS

EP 2586502 A1 5/2013
WO 2009/013679 A2 1/2009
WO 2009/070083 A1 6/2009
WO 2013/151770 A1 10/2013

* cited by examiner

WEIGHT SENSING BASE FOR AN ADJUSTABLE DUMBBELL SYSTEM

FIELD

The present disclosure relates generally to a weight-sensing base, and more specifically to a weight-sensing base for an adjustable dumbbell system.

BACKGROUND

Adjustable dumbbells generally include a handle and multiple weight plates that may be selectively coupled to and decoupled from the handle. A user may select the amount of weight to use for a dumbbell exercise, which causes selected weight plates to be coupled to the handle. Weight plates not used to make up the desired exercise weight are decoupled from the handle. The adjustable dumbbell is typically supported in a base structure, which holds the dumbbell when not in use, as well as retains the unused weight plates during use of the dumbbell. Because the total weight of the dumbbell is determined by a combination of individual weights that vary depending on user selections, it may be useful to provide data in an electronic format that is indicative of the total weight of the dumbbell based upon the currently selected weight combination.

SUMMARY

Examples of a weight-sensing base for an adjustable dumbbell system are described herein. In one aspect, the adjustable dumbbell system may include an adjustable dumbbell and a base. The adjustable dumbbell may include a handle assembly and a plurality of weight plates. The plurality of weight plates and the handle assembly may be configured such that each of the plurality of weight plates can be selectively coupled to and decoupled from the handle assembly. The base may be configured to support each of the plurality of weight plates, and the base may include a sensing mechanism configured to sense a characteristic of the plurality of weight plates where the characteristic depends upon which of the plurality of weight plates are supported by the base.

In some implementations, the adjustable dumbbell system may further include a display device configured to display a number that is determined using the characteristic.

In some implementations, the characteristic is a total aggregate weight of the plurality of weight plates that are supported on the base at the time of sensing by the sensing mechanism.

In some implementations, the number represents a calculated weight of the adjustable dumbbell where the calculated weight of the adjustable dumbbell is calculated by adding a weight of a handle assembly to a difference between a total aggregate weight of all of the plurality of weight plates and a total aggregate weight of the plurality of weight plates that are supported on the base.

In some implementations, the characteristic is how many of the plurality of weight plates are supported on the base at the time of sensing by the sensing mechanism.

In some implementations, the display device is disposed on the handle assembly, and the base further includes a wireless transmitter configured to transmit data to the handle assembly.

In some implementations, the adjustable dumbbell system further includes a processor and at least one memory. The at least one memory may be operably linked to the processor.

The at least one memory may include instructions, which when executed on the processor, cause the processor to receive sensor data generated by the sensing mechanism sensing the characteristic of the plurality of weight plates and process the sensor data to determine a calculated weight of the adjustable dumbbell.

In some implementations, the processor is associated with the base, the data that is transmitted by the wireless transmitter includes the calculated weight of the adjustable dumbbell, and the number represents the calculated weight. In such implementations, the adjustable dumbbell system may further include a second processor associated with the handle assembly. The second processor may cause the number to be displayed on the display device.

In some implementations, the processor is associated with the handle assembly, and the data transmitted by the wireless transmitter includes the sensor data.

In some implementations, the adjustable dumbbell system further includes a communication interface configured to transmit data to an electronic device associated with a user, which data is used by the electronic device to display a number that is determined using the characteristic.

In some implementations, the display device is disposed on the base.

In some implementations, the characteristic is total aggregate weight of weight plates supported on the base, and the sensing mechanism includes one or more load cells that sense a total aggregate weight of the plurality of weight plates that are supported on the base.

In some implementations, the characteristic is weights of weights plates supported on the base, and the sensing mechanism includes a plurality of load cells that each sense a weight of a particular weight plate of the plurality of weights in the event that the particular weight is supported on the base.

In some implementations, the characteristic is presence of weight plates on the base, and the sensing mechanism includes a plurality of sensors that each detects a presence of a particular weight plate of the plurality of weights in the event that the particular weight plate is supported on the base.

In some implementations, each sensor includes a first electrical contact that is disposed on the base and that engages a second electrical contact disposed on the particular weight plate so as to signal that the particular weight plate is supported on the base.

In some implementations, each sensor includes a mechanical switch that closes when engaged by the particular weight plate so as to signal that the particular weight plate is supported on the base.

In some implementations, the adjustable dumbbell further includes a switch that is configured to provide power to at least the sensing mechanism in response to the handle assembly being removed from the base.

In another aspect, a base for an adjustable dumbbell system may include a support structure, a sensing mechanism, and a communication interface. The base may be configured to support a dumbbell as the dumbbell is adjusted so as to attach and detach one or more of a plurality of weight plates to and from a handle assembly of the dumbbell. The support structure may include at least one positioning wall that supports at least one of the detached weight plates in an upright position when the dumbbell is removed from the support structure. The sensing mechanism may be associated with the support structure and configured to sense a characteristic of the detached weight plates that remain in the base. The communication interface may be configured to transmit data across a communication link, which data may include at least one of the characteristics or a current estimated weight of the dumbbell where the current estimated weight of the dumbbell is determined using the characteristic.

In some implementations, the communication link may be wireless, and the dumbbell may be configured to receive the data from across the communication link. The dumbbell may include a display device configured to display the current estimated weight of the dumbbell.

In some implementations, the communication interface transmits data across the communication link to an electronic device associated with a user of the dumbbell, and the electronic device displays the current estimated weight of the dumbbell.

In some implementations, the base further includes a display device configured to receive the data from across the communication link and further configured to display the current estimated weight of the dumbbell.

In some implementations, the support structure includes a top wall and sidewalls that define at least one recess.

In some implementations, the support structure includes at least one rib extending upwardly from the top wall and that defines the at least one positioning wall.

In some implementations, the support structure includes inner and outer end walls that define at least some of the positioning walls.

In some implementations, a portion of the outer end wall that defines a positioning wall is disposed at an obtuse angle with respect to the top wall.

In some implementations, the support structure comprises a plurality of ribs extending inwardly from the sidewalls and that define the at least one positioning wall.

In another aspect, a method for utilization with an adjustable dumbbell may include reading sensor data generated by a sensing mechanism that is associated with a base portion of an adjustable dumbbell system and transmitting data across a communication link. The sensing mechanism may be configured to sense a characteristic of a plurality of weight plates that are detached from a handle assembly of the adjustable dumbbell so as to remain in the base when the adjustable dumbbell is removed from the base, and the transmitted data may be based on the one or more attributes of the detached weight plates and indicates a current weight of the adjustable dumbbell In some implementations, the method may further include: processing the sensor data to determine a total aggregate weight for the plurality of weight plates that remain in the base; determining the weight of the adjustable dumbbell based on the total weight for the plurality of weight plates that remain in the base; receiving the data from across the communication link, wherein the data received from across the communication link may include the weight of the adjustable dumbbell; and displaying the weight of the adjustable dumbbell based on the data received from across the communication link.

In some implementations, the method may further include: receiving the data from across the communication link, wherein the data received from across the communication link includes the sensor data; processing the sensor data to determine a total aggregate weight for the plurality of weight plates that remain in the base; determining the weight of the adjustable dumbbell based on the total weight for the plurality of weight plates that remain in the base; and displaying the weight of the adjustable dumbbell.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

DETAILED DESCRIPTION

Figures 1A, 1B:
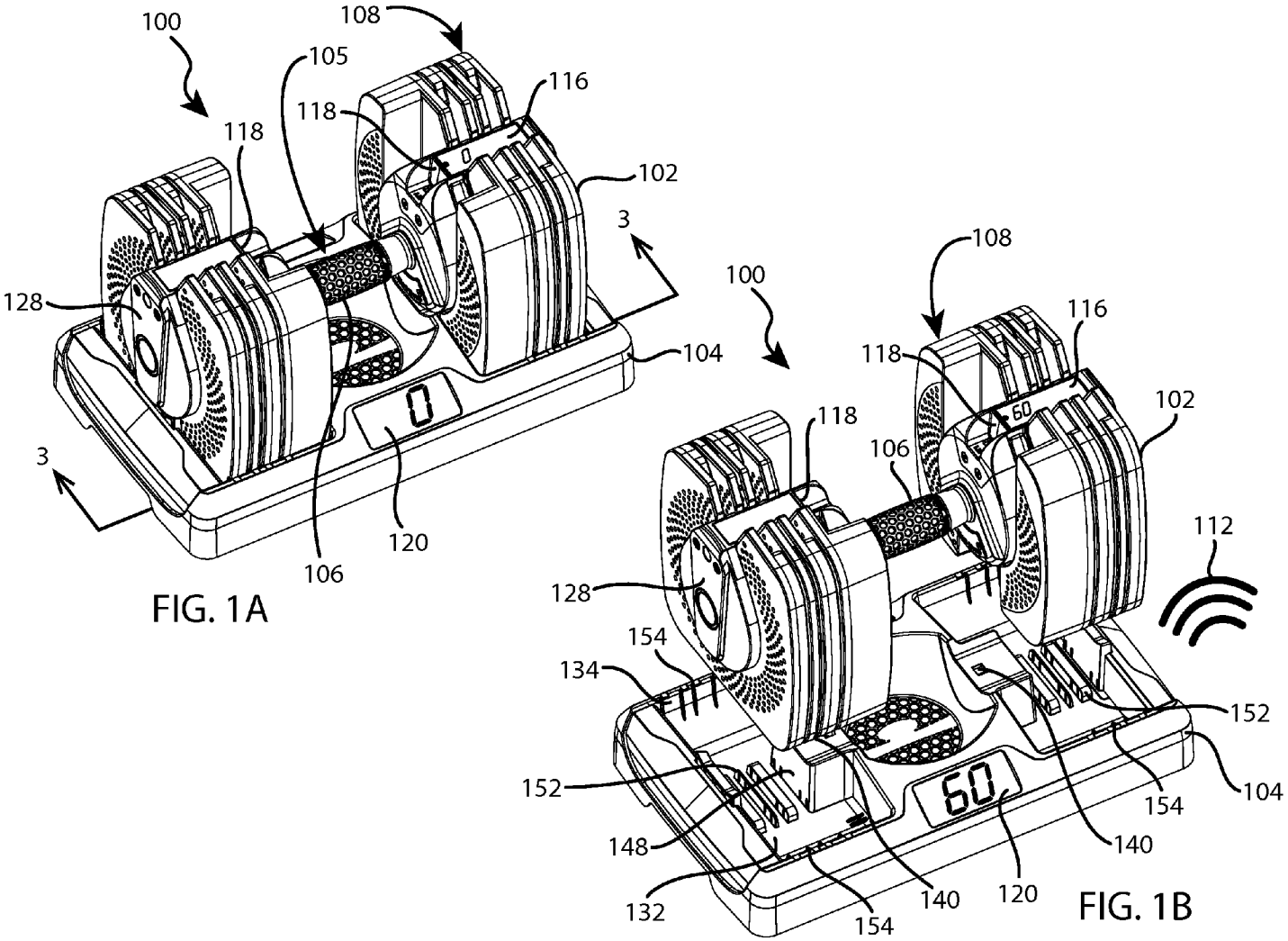
FIG. 1A is an isometric view of an adjustable dumbbell system including an adjustable dumbbell and a base in accordance with an example of the present disclosure.
FIG. 1B is an isometric view of the dumbbell system of FIG. 1A that shows a communication link between the base and the adjustable dumbbell.
Figure 1C:
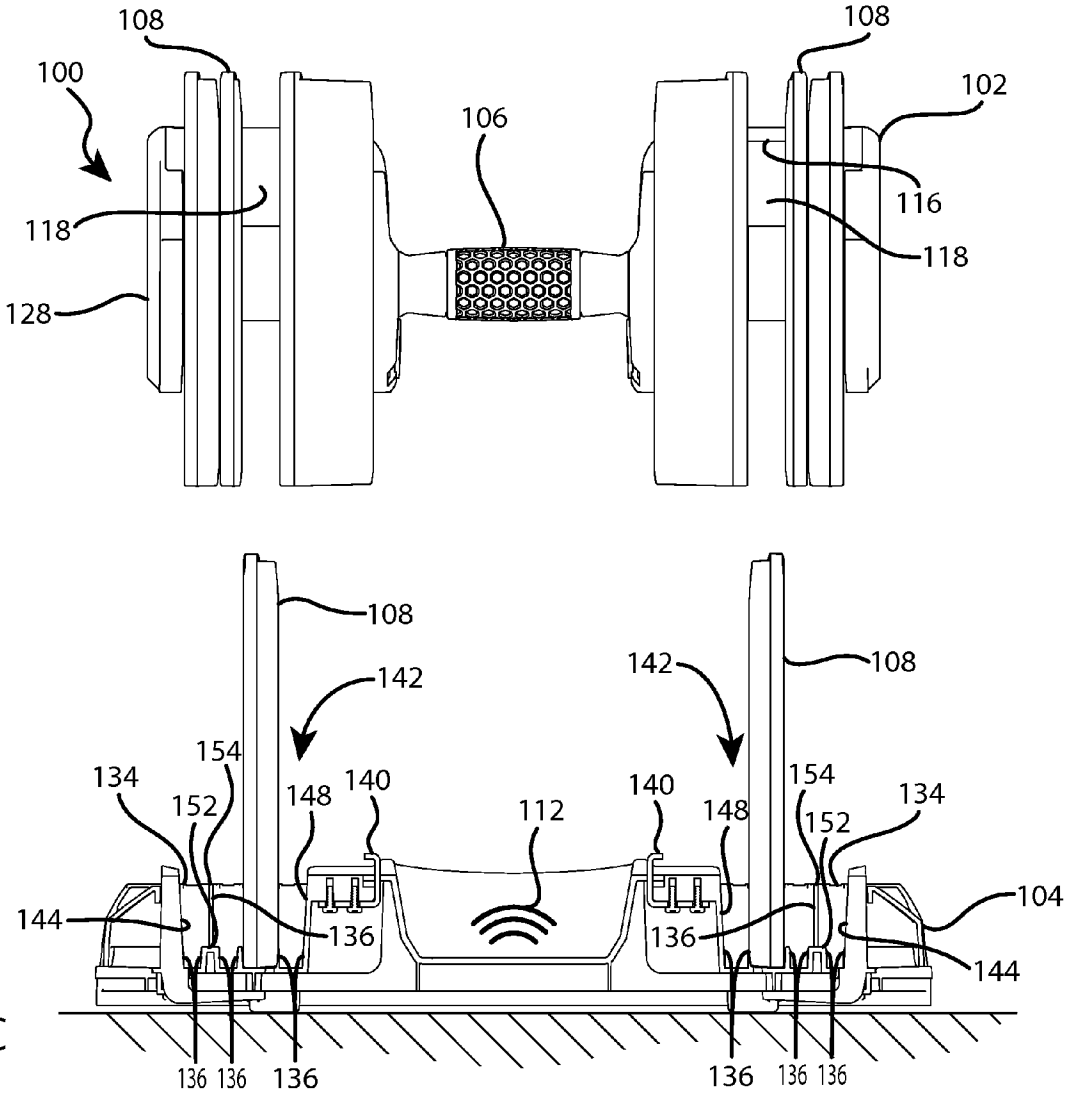
FIG. 1C is a front elevation view of the dumbbell system of FIG. 1A that shows weight plates remaining in the base.

The present disclosure provides a weight-sensing base for an adjustable dumbbell system. Referring to FIGS. 1A-C, an adjustable dumbbell system 100 may include an adjustable dumbbell 102 and a base 104. The adjustable dumbbell 102 may include a handle assembly 105 and one or more weights, such as weigh plates 108 or the like. The handle assembly may include a handle 106.

To change the weight of the dumbbell 102, the user may place the dumbbell 102 in the base 104 as shown in FIG. 1A, and turn the handle 106 or otherwise actuate an adjustment mechanism of the dumbbell 102. Turning the handle 106 or otherwise adjusting the adjustment mechanism engages a desired combination of weights, which in one example are weight plates 108. As shown in FIGS. 1B-C, the user may then remove the dumbbell 102 from the base 104 to perform a desired exercise. The desired dumbbell weight is made up by the combination of weight plates 108 coupled to the dumbbell 102 when lifted out of the base. Unused weight plates 108 may remain in the base 104 as shown in FIG. 1C. Should the user desire a different dumbbell weight, the user may place the dumbbell 102 back in the base 104, turn the handle 106 to engage the desired weight plates 108, and remove the dumbbell 102, having the newly selected weight plates, from the base 104. When the adjustable dumbbell 102 is not in the base 104, for example during exercise-type use, the adjustable dumbbell 102 may be configured such that decoupling the weight plates 108 from the handle 106 is difficult.

The base 104 may be generally configured to detect a characteristic of the unused weight plates 108 that remain in the base 104 when the dumbbell 102 is in use. The base 104 may be further configured to transmit data to one or more electronic devices across a communication link. The data transmitted across the communication link may indicate the weight of the dumbbell 102 and may be based on the detected characteristic of the unused weight plates 108 remaining in the base 104. In accordance with various embodiments, the base 104 may sense the weight and/or the presence of unused weight plates 108 remaining in the base 104. The base 104 may compare this sensed information to known or sensed weight values for the handle 106 and the full set of weight plates 108 so as to calculate the total weight of the dumbbell 102. The base 104 may then transmit the results of this calculation across the communication link as data. Alternatively, the base 104 may sense the weight and/or the presence of unused weight plates 108 remaining in the base 104 and transmit this information across the communication link as raw data. The electronic device receiving this raw data may then calculate the total weight of the dumbbell 102 by comparing the raw data to known or sensed weight values for the handle 106 and the full set of weight plates 108.

Figure 2:
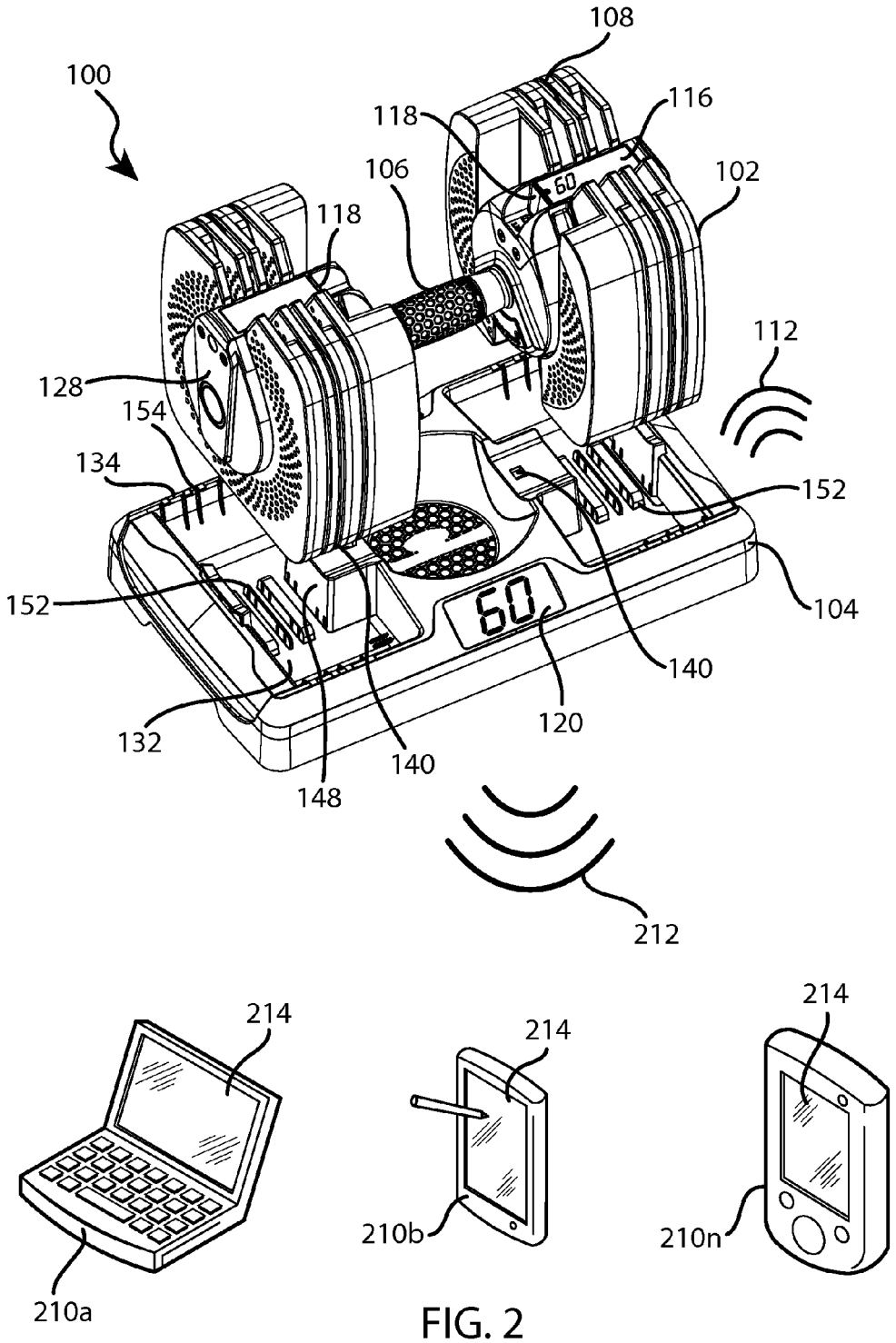
FIG. 2 is an isometric view of the dumbbell system of FIG. 1B that shows a communication link between the base and one or more user devices.

The base 104 may be configured to transmit data across one or more wired or wireless communication links. Electronic devices that receive the data from the base 104 may be display devices or computing devices that may be associated with display devices. In this way, an electronic device may receive data from the base 104 and, based on this data, provide output that indicates the weight of the dumbbell 102. This weight may include the weight of the handle assembly 105 and the weight of the weight plates 108 coupled to the handle assembly 105. This weight is generally referred to herein as "the weight of the dumbbell," "the current handle weight," "the current weight of the handle," and so on. Referring to the example configuration of FIG. 2, the base 104 may transfer data across a wireless communication link 112 that exists between the base 104 and the dumbbell 102. A dumbbell display device 116 may then output the weight of the dumbbell 102 based on the data received from across the wireless communication link 112. The base 104 may also transfer data across a wired or wireless communication link that exists between the base 104 and a base display device 120 that may be in physical contact with the base 104. Based on this data, the base display device 120 may then output the weight of the dumbbell 102. Additionally, the base 104 may transfer data to one or more user devices 210*a-n*. For example, as shown in FIG. 2, the base 104 may transfer data across a wireless communication link 212 that exists between the base 104 and one or more user devices, such as a laptop computer 210*a*, a tablet computer 210*b*, a mobile phone 210*n*, and so on. One or more of the user devices 210*a-n* may then output the weight of the dumbbell 102 on a display device 214 associated with the user device 210*a-n*.

The Adjustable Dumbbell

The adjustable dumbbell system 100 may include an adjustable dumbbell 102 having the handle assembly 105 and a plurality of weight plates 108 that can be selectively engaged by user operation of an adjustment mechanism on the dumbbell 102. In one implementation, the adjustment mechanism is the handle 106, which may be rotated to set a desired weight by coupling a desired combination of weight plates 108 to an engagement structure 128. Other adjustment mechanisms that may be used include rotatable dials, levers, knobs, and so on. The handle assembly 105 may include an engagement structure 128 disposed on each end of handle 106, or one engagement structure 128 may encompass both ends of the handle 106. The base 104 may receive the dumbbell 102 and may be configured to unlock the adjustment mechanism to allow a user to adjust the weight of the dumbbell 102 as the dumbbell 102 rests on the base 104. During use of the dumbbell 102, the base 104 may hold the weight plates 108 that are not attached to the dumbbell 102. As such, before using the dumbbell 102 the user may first determine the weight to be lifted and rotate the handle 106 while the dumbbell 102 is in the base 104, causing no weight plates 108 or one or more weight plates 108 to be fixedly connected to the handle assembly 105. The user may then lift the dumbbell 102 out of the base 104. Any weight plate 108 not fixedly connected with the handle assembly 105 remains in the base 104.

The base 104 may include a support structure that is configured to support the dumbbell 102 during coupling and decoupling weight plates 108 to and from the handle assembly 105 and to support the detached weight plates 108 when the dumbbell 102 is removed from the support structure. The support structure may include a top wall 132, sidewalls 134, and one or more positioning walls 136. The top wall 132 and sidewalls 134 may define one or more recesses 142 in the base 104. The base 104 may be configured such that one recess 142 is located at either end of base 104. As used herein, a recess 142 is defined by a floor or bottom wall and generally four sidewalls 134, where the top wall 132 of the base 104 forms the floor or bottom wall of the recess 142. The sidewalls 134 may include outer end walls 144 that are each adjacent to an outer surface of an outer weight plate 108. Similarly, the sidewalls 134 may include inner end walls 148 that are each adjacent to an inner surface of an inner weight plate 108. The top wall 132 may support the adjustable dumbbell 102 when received in the base and any unused weight plates 108 when the dumbbell 102 is removed from the base 104.

Within each of the recesses 142, a plurality of ribs 152 may be positioned on the upwardly facing surface of the top wall 132. Each rib 152 may include opposing lateral faces that form positioning walls 136 that support the unused weight plates 108. Additional positioning walls 136 may be formed by lower portions of the inner end walls 148 and the lower portions of the outer end walls 144. The positioning walls 136 help ensure that the adjustable dumbbell 102 is properly aligned when it is inserted into the base 104. The positioning walls 136 may hold the weight plates 108 upright and in the proper location relative to the handle 106 so that the adjustable dumbbell 102 may be inserted into and removed from the base 104. Specifically, the lower end of a weight plate 108 may be received between adjacent positioning walls 136, which then bear against the lower end of the weight plate 108 to assist in maintaining the weight plate in an upright position when not selected, and to maintain the weight plate in alignment for ease of insertion of the dumbbell back into the base. The positioning walls help resist excessive tipping of the weight plate 108 out of alignment, and help keep each weight plate from entirely falling to either side under the influence of its own weight. The ribs 152 may be spaced so as to fit between adjacent weight plates 108 when the dumbbell 102 rests in the base 104 and so that the positioning walls 136 associated with the ribs 152, the outer end walls 144, and the inner end walls 148 maintain any weight plate 108 decoupled from the dumbbell 102 in an upright position when the dumbbell 102 is removed from the base 104. The inner end wall 148 may form an obtuse angle with the floor, with the lower portion 136 of the inner end wall forming a positioning wall and in engagement with the bottom edge of the inner side of the weight plate. The obtuse angle causes the inner end wall 148 to taper away from the weight plate, and does not obstruct or otherwise interfere with the inner surface of the inner weight plate 108 as the dumbbell 102 is placed in or removed from the base 104. Similarly, the outer end wall 144 may form an obtuse angle with the floor, with the lower portion 136 of the outer end wall 144 forming a positioning wall and being in engagement with the bottom edge of the outer side of the weight plate. The obtuse angle causes the outer end wall 144 to taper away from the weight plate, and does not obstruct or otherwise interfere with the outer surface of the outer weight plate 108 as the dumbbell 102 is placed in or removed from the base 104.

One or more of the recesses 142 may additionally include lateral support ribs 154 positioned on the inwardly facing surface of one or more sidewalls 134 of the recess 142. Like the ribs 152 associated with the top wall 132, the lateral support ribs 154 may include opposing lateral faces that support the unused weight plates 108. Here, a lateral end of a weight plate 108 (which extends generally upwardly or vertically relative to the bottom edge) may be received between adjacent positioning walls 136 formed by the lateral faces of adjacent lateral support ribs 154. In this position, the lateral faces of the lateral support ribs 154 may bear against the lateral end of the weight plate 108 so as to further support the weight plate in an upright position. In some embodiments, one, or two adjacent lateral support ribs 154 may be disposed on each opposing side wall 134. The ribs 152 and 154 may be positioned in alignment with each other. In this way, a weight plate 108 may be supported in three locations, including at the lower end of the weigh plate 108 (where it engages the ribs 152) and at two lateral ends of the weight plate 108. In some embodiments, the lateral support ribs 154 may be omitted such that only the lower ends of the weight plates 108 are supported by points of contact that include the ribs 152 associated with the top wall 132.

The ribs 152 associated with the top wall 132 are generally illustrated and described herein as extending upwardly from the top wall 132. Similarly, the lateral support ribs 152 associated with the sidewalls 134 are generally illustrated and described herein as extending inwardly from the side walls 134. In other embodiments, positioning walls or other support surfaces that support the weight plates 108 in upright positions may be formed by grooves in one or more surfaces of the recesses 142. Thus, rather than upwardly extending ribs 152, the top wall 132 may include downwardly extending grooves. Similarly, rather than inwardly extending lateral support ribs 154, the sidewalls 134 may include outwardly extending lateral support grooves.

The base 104 may additionally include one or more lock features that deactivate a locking mechanism associated with the adjustable dumbbell 102 to allow selection of different weights when the adjustable dumbbell 102 is in the base 104. In the example configuration of FIGS. 1A-C, the lock features 140 may be disposed on a raised portion of the base 104 such that the lock features 140 engage the dumbbell 102 when the dumbbell 102 is received in the base 104. The lock features 140 may be formed from a relatively rigid metal, plastic, or other suitable material. Each lock feature 140 may extend upwardly from the base 104. In some embodiments, each lock feature 140 may include a plate-like vertical portion that extends upwardly from the base 104 with a plate-like horizontal portion that extends substantially perpendicular from an end portion of the vertical portion that is distal from the base 104. The arrangement of the vertical and horizontal portions of each lock feature 140 may resemble an L-shaped profile for the portion of the lock feature 140 extending above the base 104. The lock features 140 may be positioned on the base 104 so as to unlock a dumbbell 102 locking mechanism to allow the dumbbell 102 to be freely adjusted by the user.

Weight Sensing Mechanisms

The base 104 may be configured to detect a characteristic of the unused weight plates 108 that remain in and are thus supported by the base 104 when the dumbbell 102 is removed from the base 104. As used herein, and as non-limiting examples, "characteristics" that may be detected include any one or more of the following items alone or in combination: the total aggregate weight of all the weights plates 108 supported by the base 104, the weight of one or more individual weight plates 108 supported by the base 104, the presence and/or absence of individual weight plates 108 in the base 104, or the like. Thus, in one implementation, the base 104 may detect the total aggregate weight of the plurality of weight plates 108 supported by the base 104. Alternatively, the base 104 may detect the individual unused weight plates 108, which weights may then be added together to determine a total weight for all the unused weight plates 108 supported by the base 104. In another embodiment, the base 104 may detect the presence or absence of individual weight plates 108 in the base 104 when the dumbbell 102 is removed from the base 104. Following this, known weight amount for those weight plates 108 detected to be present in the base 104 may be added together to determine a total weight for all the unused weight plates 108 supported by the base 104. Here, weight amounts for the individual weight plates 108 may be known based on their slot position in the base 104. In this embodiment, the presence and/or absence of individual weight plates 108 in the base 104 is considered a "characteristic" of the weight plates 108 that is detected by the base 104. In each of these various embodiments, the total weight for all the unused weight plates 108 remaining in the base 104 may be compared to known or measured values of the weight of the dumbbell having all of the weight plates 108 coupled thereto to determine the weight of the dumbbell 102.

Figure 3:
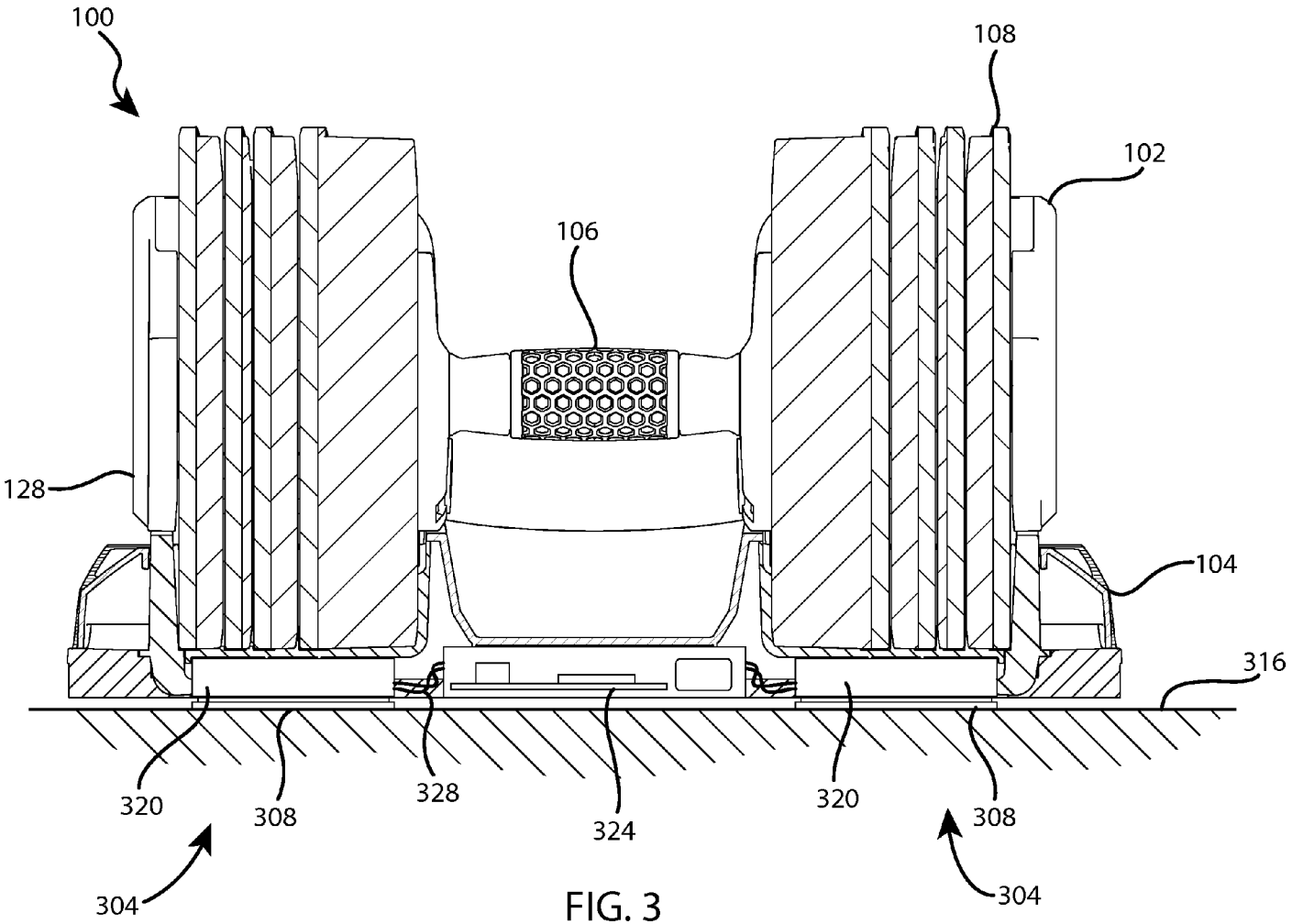
FIG. 3 is a front elevation view of an adjustable dumbbell received in a base, with the base shown in longitudinal cross section.
Figure 4:
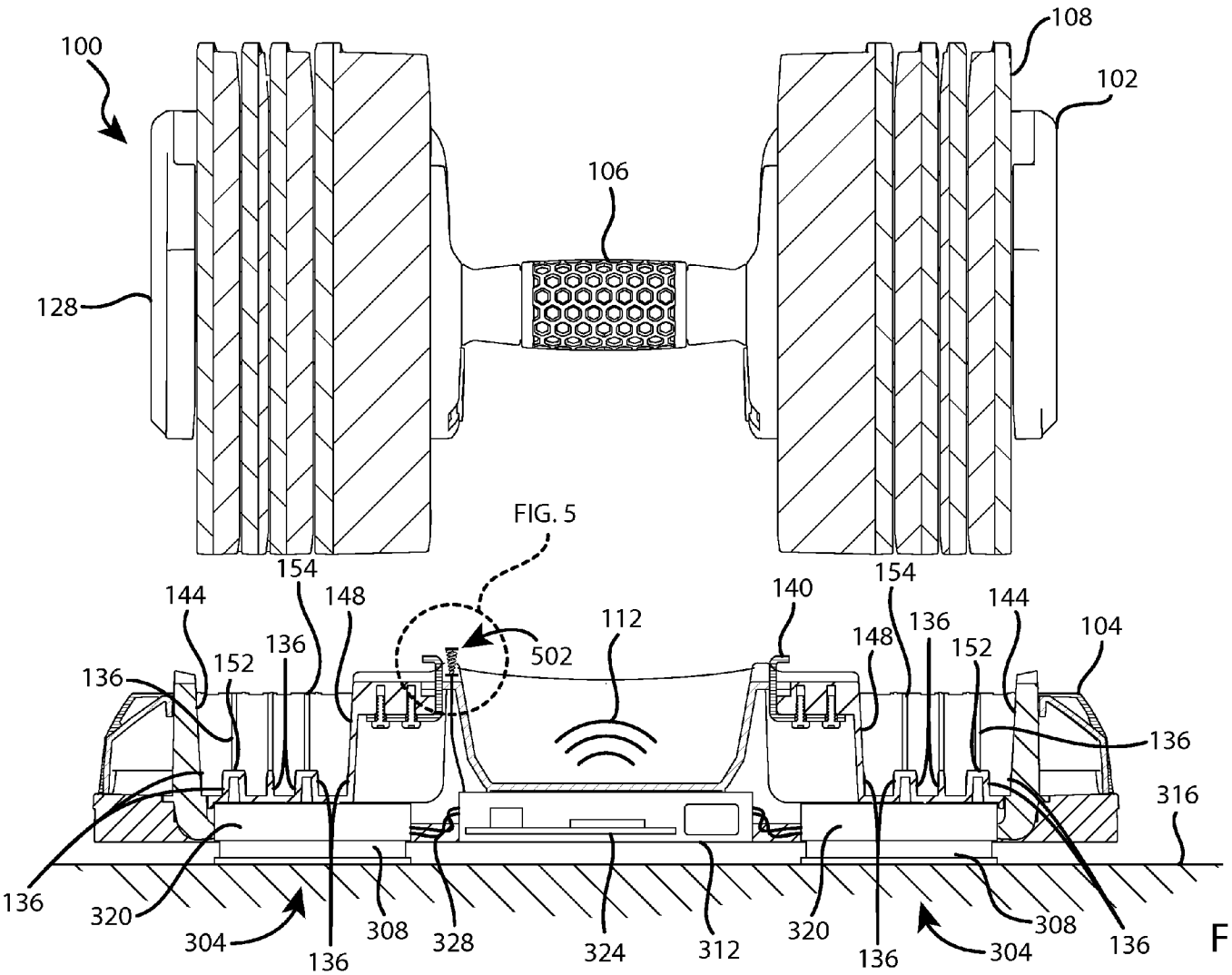
FIG. 4 is the dumbbell and base of FIG. 3 with the dumbbell removed from the base.

Referring to FIGS. 3 and 4 the base 104 may include one or more load cells 304. In some implementations, the loads cells 304 may be configured to sense the total aggregate weight of the unused weight plates 108 remaining in the base 104. Other implementations include loads cells 304 that sense weight amounts of individual weight plates 108. The load cells 304 may include a lower member 308 located on the bottom 312 of the base 104. The lower member 308 may rest on the floor 316 or other surface on which the base 104 is placed. The lower member 308 may be provided in association with an upper member 320 that is configured to sense a pressure change or other parameter due to mechanical loading.

Generally, the load cells 304 may be positioned in the base 104 so as to be exposed to the load presented by the weight plates 108. The load cells 304 may be spaced on the bottom 312 of the base 104 in order to equally support the base 104, or may be calibrated for unique spacing. The load cells 304 may also be built into the interior of the base 104 so to be positioned between the recessed top wall 132 and the bottom 312 of base 104. The load cells 304 may also be adjusted to accommodate attenuation of the weight due to the recessed top wall 132 having some resistance to deflection. In one respect, the load cells 304 may function to measure the weight of the unused weight plates 108 remaining in the base 104 by measuring the displacement of the upper member 320 or a pressure against the upper member 320 that occurs when the dumbbell 102 is removed with some, all, or none of the weight plates 108 coupled thereto. Specifically, the weight plates 108 remaining in the base 104 present a mechanical load against the upper member 320, which load can then be correlated with a corresponding weight amount.

In response to the mechanical loading from the weight plates 108 remaining in the base 104, the load cells 304 may provide a displacement signal or other appropriate output signal to a computing device 324 or other circuit associated with the base 104. As can be seen in FIGS. 3 and 4, the base 104 may include signal wires 328 that carry this displacement signal from the load cells 304 to the base computing device 324. As described in greater detail below, the base computing device 324 may be configured to transmit data across one or more communications links, which data may indicate the amount of weight on the handle assembly 105 and which data may be based on the weight of the unused weight plates 108 remaining in the base 104 as measured by the load cells 304.

Figure 6:
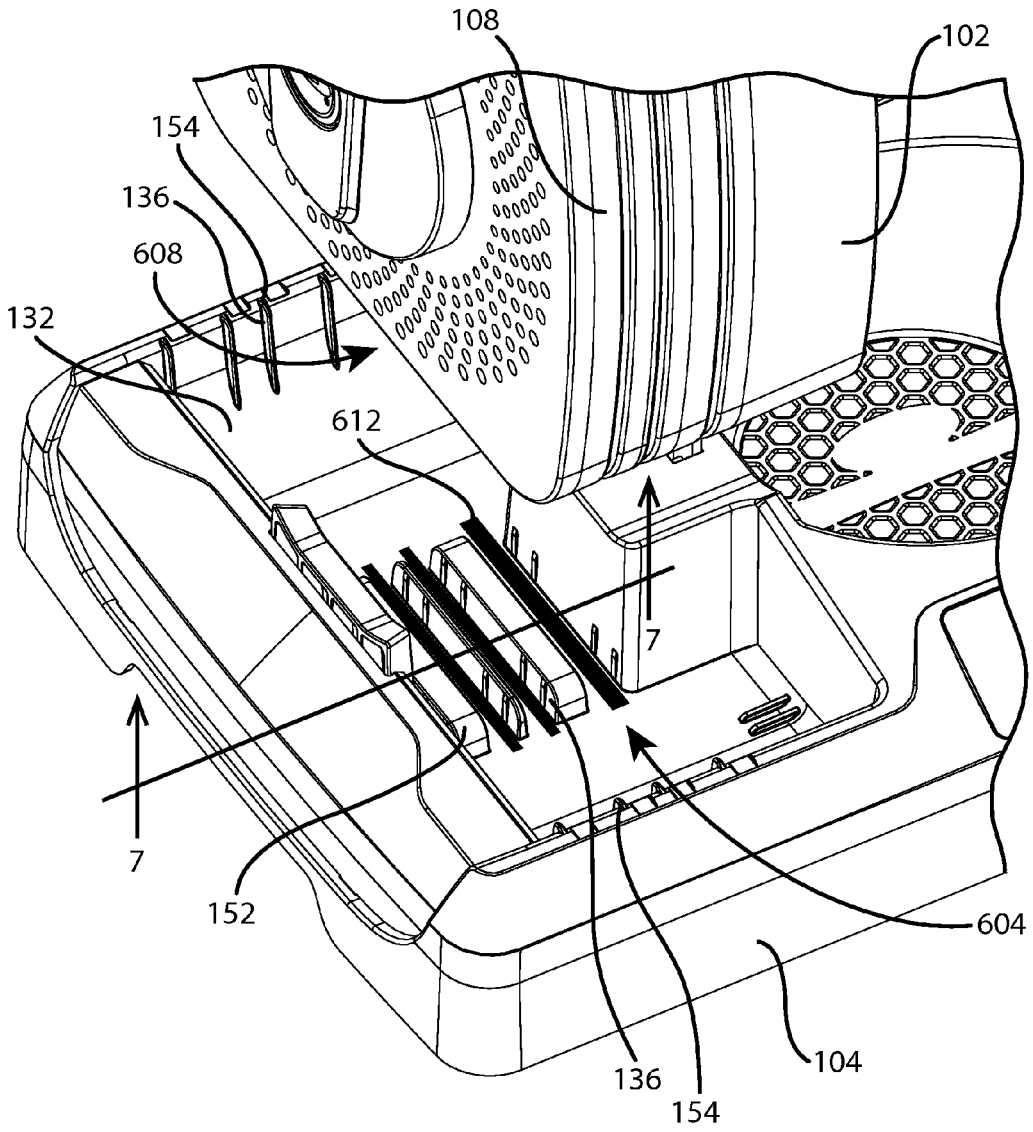
FIG. 6 is a perspective view of a portion of a base of an adjustable dumbbell system implementation that includes an individual weight sensing mechanism in the base.

Referring to FIG. 6, the base 104 may include individual weight sensors 604 that sense the presence or absence of individual weight plates 108 in the base 104. Each individual weight sensor 604 is arranged in the base 104 so as to be aligned with a particular weight plate 108 when the dumbbell 102 sits in the base 104. In the example configuration of FIG. 6, one or more of the individual weight sensors 604 are implemented as elongated strips that are located on the recessed top wall 132 between the ribs 152 of the base 104. When the dumbbell 102 is received in the base 104, one or more of the individual weight plates 108 are received between the ribs 152. In one respect, the positioning walls 136 associated with ribs 152 may function to maintain the unused weight plates 108 remaining in the base 104 in upright positions when the dumbbell 102 is removed from the base 104. In another respect, the positioning walls 136 associated with ribs 152 may function to maintain one or more of the unused weight plates 108 remaining in the base 104 in alignment with a particular individual weight sensor 604. Specifically, a weight plate 108 may be positioned such that the weight plate 108 sits on top of the sensor 604 such that a downward facing surface 608 or other portion of the weight plate 108 contacts an upward facing surface 612 of the sensor 604. The individual weight sensor 604 may detect the presence or absence of the weight plate 108 through this contact between adjacent surfaces. As alluded to above, the individual weight sensors 604 could also be implemented as individual load cells.

Figure 7:
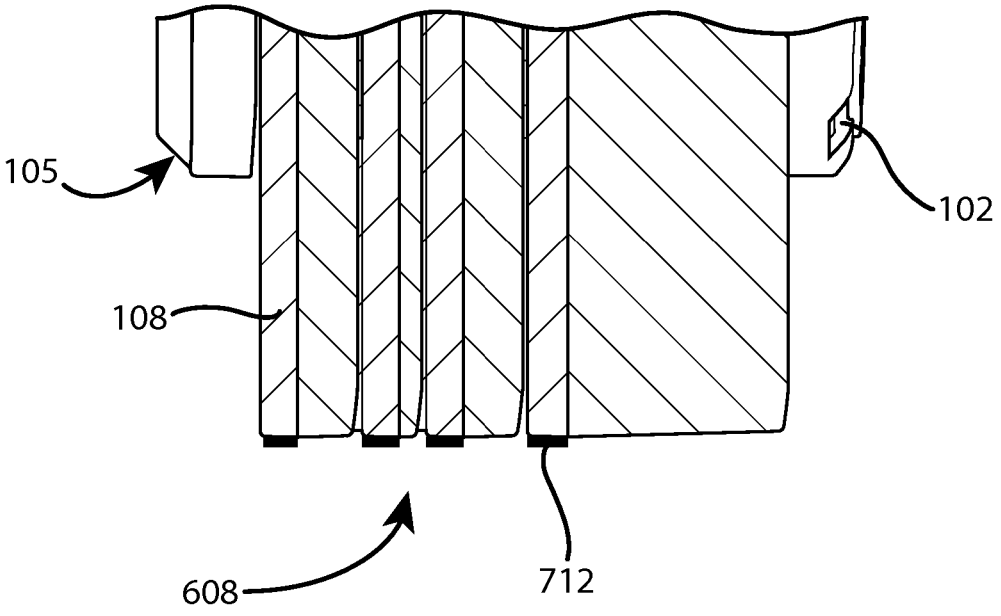
FIG. 7 is a partial section view taken along line 7-7 of FIG. 6 that shows an electrical sensor implementation in the base.
Figure 7:
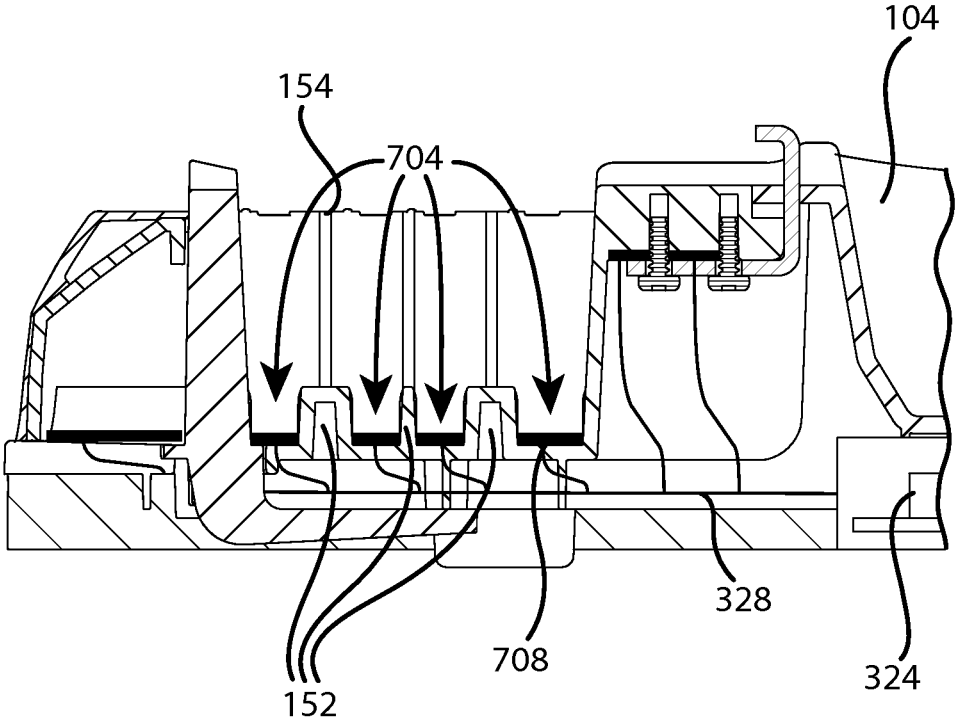

Referring to FIG. 7, an individual weight sensor may be an electronic sensor 704. The electrical sensor 704 may operate to change the condition of an electrical circuit depending on whether a particular weight plate 108 remains or does not remain in the base 104. For example, an electrical sensor 704 may close a circuit in the event that a weight plate 108 remains in the base 104. Conversely, the electrical sensor 704 may open the circuit in the event that a weight plate 108 does not remain in the base 104. In the example configuration of FIG. 7, an electrical sensor 704 includes a lower electrical contact 708 associated with the base 104. The lower electrical contact 708 may be arranged between one or more ribs 152, as shown in FIG. 6. The lower electrical contact 708 may be associated with a corresponding upper electrical contact 712 on a weight plate 108. The upper electrical contact 712 may be disposed on the bottom facing surface 608 of the weight plate 108 so as to be aligned with the lower electrical contact 708 when the weight plate 108 remains in the base 104. In this position, the interaction between the upper 712 and lower 708 electrical contacts may change a circuit condition so that the presence of the weight plate 108 in the base 104 is thereby registered. Together, the electrical sensors 704 may provide output signals across signal wires 328 to the base computing device 324. As described in greater detail below, the base computing device 324 transmits data across one or more communications links, which data may indicate the amount of weight on the handle assembly 105 and which data may be based on the weight of the weight plates 108 remaining in the base 104 as measured by the electrical sensors 704.

Figure 8:
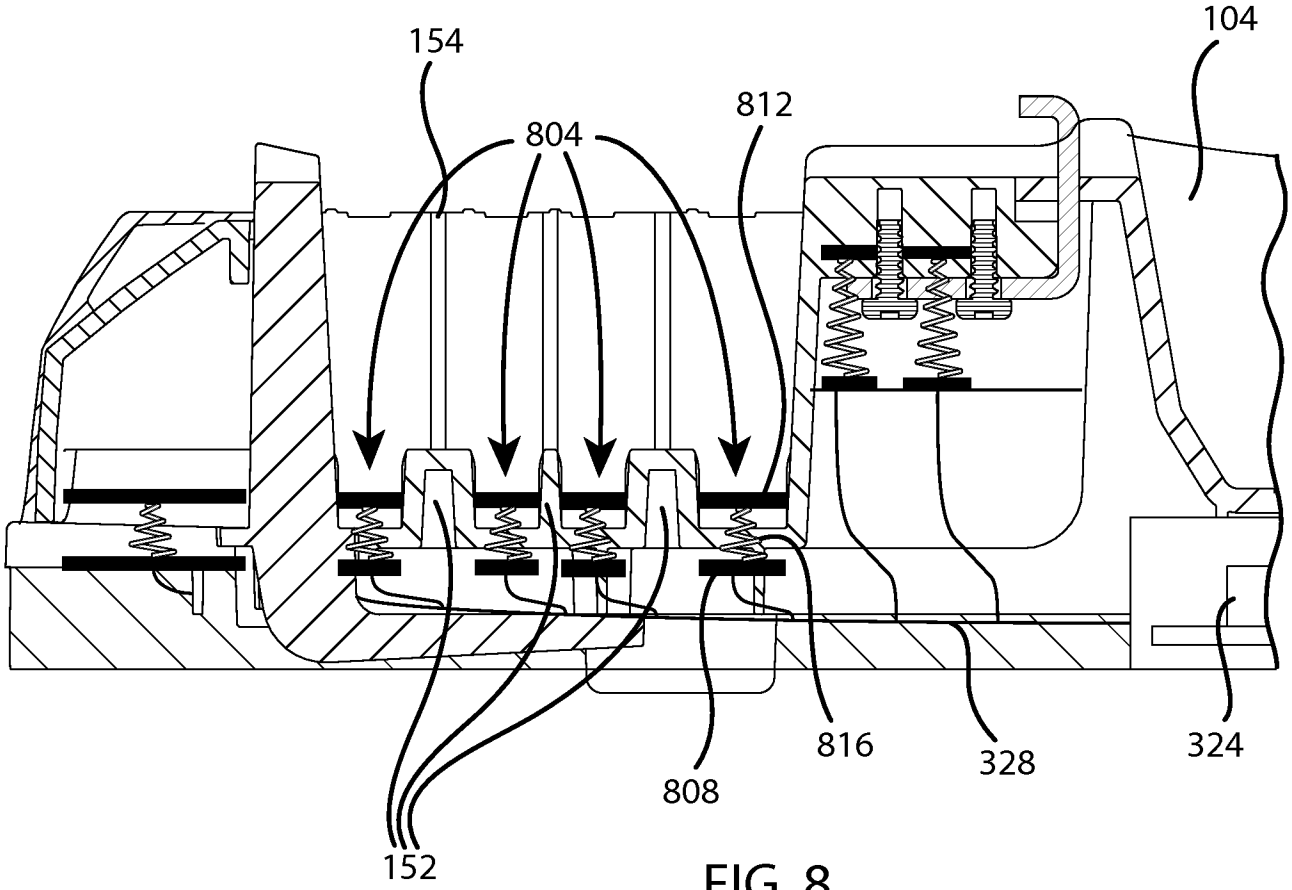
FIG. 8 is a partial section view taken along line 7-7 of FIG. 6 that shows a mechanical sensor implementation in the base.

Referring to FIG. 8, an individual weight sensor may be a mechanical sensor 804. The mechanical sensor 804 may include a switch that opens or closes depending on whether a particular weight plate 108 remains or does not remain in the base 104. For example, the switch associated with the mechanical sensor 804 may close in the event that a weight plate 108 remains in the base 104. Conversely, the switch associated with the mechanical sensor 804 may open in the event that a weight plate 108 does not remain in the base 104. In the example configuration of FIG. 8, a mechanical sensor 804 may be arranged between one or more ribs 152 in the base 104. The mechanical sensor 804 may include first 808 and second 812 switch members that are maintained at a certain distance from each other by a spring 816 or other biasing member. The second switch member 812 may be arranged so as to be engaged by the bottom facing surface 608 of the weight plate 108 when the weight plate 108 remains in the base 104. In this position, the weight plate 108 may mechanically load the second switch member 812 and thereby trigger the mechanical sensor 804 by driving the first 808 and second 812 switch members together against the action of the spring 816. Together, the mechanical sensors 804 may provide output signals across signal wires 328 to the base computing device 324. As described in greater detail below, the base computing device 324 transmits data across one or more communications links, which data may indicate the amount of weight on the handle assembly 105 and which data may be based on the weight of the weight plates 108 remaining in the base 104 as measured by the mechanical sensors 804.

FIGS. 7 and 8 provide examples of, respectively, electrical and mechanical sensors that may operate to detect the presence or absence of individual weight plates 108 that remain in the base 104 when the dumbbell is in use. Other examples of sensors that be used to detect the presence or absence of individual weight plates 108 include proximity sensors, optical interrupt sensors, optical reflection sensors, capacitive sensors, inductive sensors, Hall effect sensors, and so on. Generally, any sensing device or mechanism may be used that is capable of indicating whether or not a particular weight plate 108 is present or not in the base 104. Knowing which weight plates 108 are present in the base 104 and knowing the weight of those plates, the total load amount can be calculated.

Data Processing and Display Components

Figure 9:
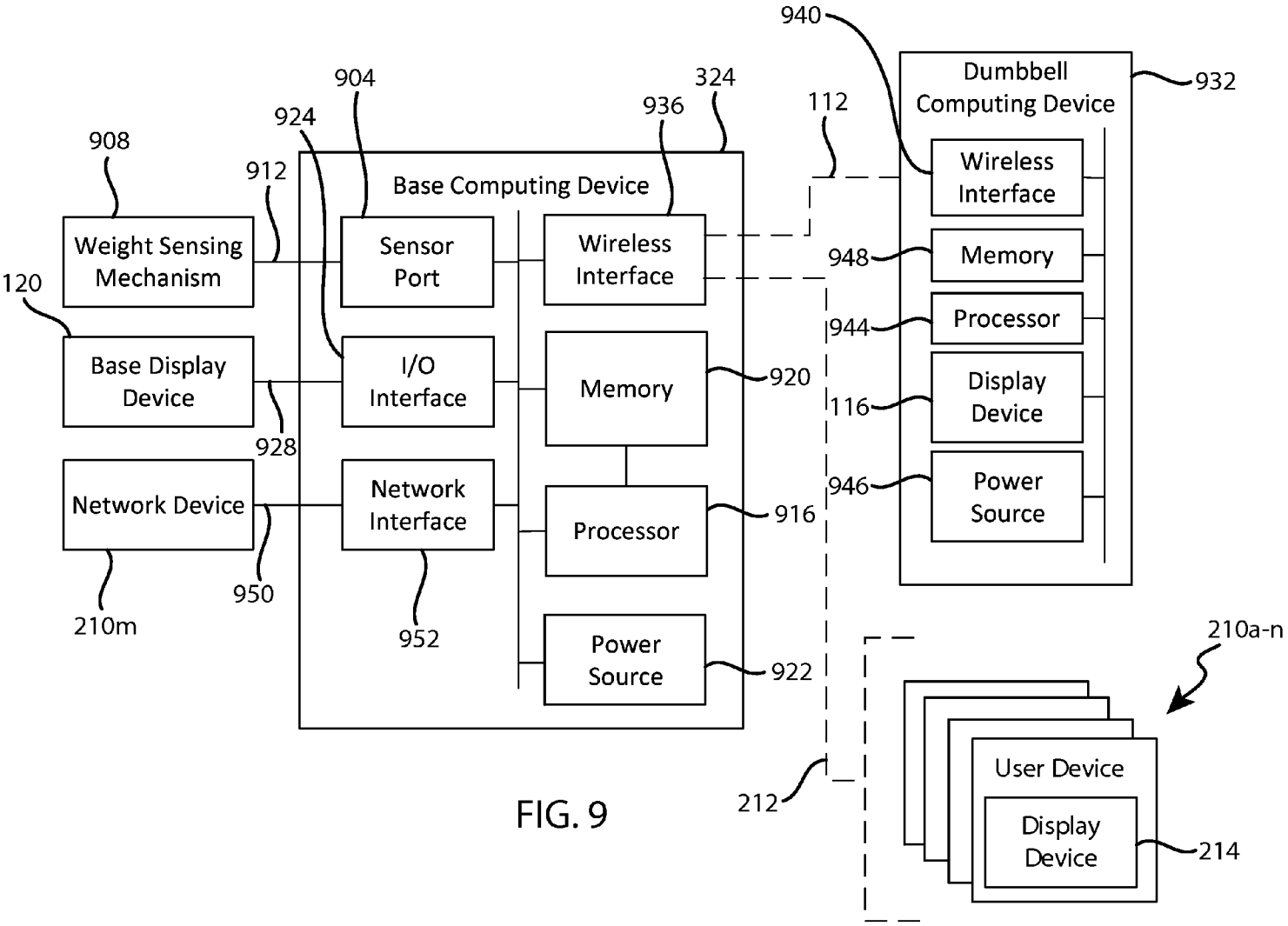
FIG. 9 is block diagram for one or more computing devices associated with the adjustable dumbbell system of FIG. 1A.

Referring to FIGS. 3-4 and 7-9, an adjustable dumbbell base 104 may include an on-board computing device, which is generally referred to herein as a base computing device 324. FIG. 9 is a block diagram of various components that may be included in the base computing device 324. The base computing device 324 may receive sensor input through a sensor port 904. The sensor port 904 may connect to a weight sensor mechanism, which in FIG. 9 is generally identified by reference number 908. In accordance with various embodiments described herein, the weight sensor mechanism 908 may be implemented as one or more load cell type weight sensors, one or more sensors that detect the presence and/or absence of individual weights, or the like. The sensor port 904 may connect to the weight sensing mechanism 908 across a sensor port communication link 912. As shown in FIGS. 3-4 and 7-8, the sensor port communication link 912 may be implemented as a wired connection 328. In other instances, the sensor port communication link 912 may be wireless.

The weight sensing mechanism 908 may provide sensor data that may then be received and processed by the base computing device 324. In this regard, the base computing device 324 may include a processor 916 provided in association with a memory 920. The processor 916 may be configured to support the various operations of the base computing device 324, including processing sensor data. The processor 916 may communicate with the memory 920, which operates to store data and/or computer readable code that is executable by the processor 916. The base computing device 324 may additionally include a power source 922 such as a battery, power supply, or the like that provides electrical power to the electrical components of the base computing device 324, including the processor 916. In some implementations, the processor 916 may subtract the weight of the unused weight plates 108 remaining in the base 104 as indicated by sensor data, from the total weight of the adjustable dumbbell 102 with the full weight set coupled thereto, to determine the current weight of the dumbbell 102. The current weight of the adjustable dumbbell 102 may then be provided as output for display either locally at the base 104 or at a downstream display device. In other implementations, the processor 916 or other base component may transmit the weight of the unused weight plates 108 remaining in the base 104 across a communication link as raw data to be further processed by a downstream computing device.

The base computing device 324 may include an input/output interface 924 that is generally configured to send and/or receive data to and/or from the user. Generally, the input/output interface 924 may be configured to send data to various output devices that generate output perceptible to a user. Various output devices that may be associated with the computing device 324 may generate output that is visible, audible, tactile, olfactory, and so on. Additionally, the input/output interface 924 may be configured to receive data from various input devices that sense user input. Various input devices that may be associated with the base computing device 324 may receive sensor data that is visible, audible, tactile, olfactory, and so on. By way of example, the input/output interface 924 may send data to the base display device 120 shown in FIGS. 1A-2. If the base display device 120 includes touch screen capabilities, the input/output interface 924 may also receive data generated by these inputs. By way of further example, the input/output interface 924 may send audio output to audio devices that may be associated with the base computing device 324, such as a speaker, a beeper, a buzzer, a tone generator, or the like. Similarly, the input/output interface 924 may receive audio input through a microphone or the like.

The base display device 120 may be positioned on the base 104 in a location that provides for convenient viewing and/or use by the user of the adjustable dumbbell system 100. As shown in the example configuration of FIGS. 1A-2, the base display device 120 may be disposed in a central location on the base 104. The base display device 120 may be disposed at an angle with respect to a substantially horizontal plane defined by the base 104 so to be visible to a user who is located adjacent to the base 104. In one implementation, the base display device 102 may be used to display the current weight of the adjustable dumbbell 102 as indicated by sensor data that is received and processed by the base computing device 324. Here, the processor 916 may drive the I/O interface 924 to provide output to the base display device 102 across a communication link 928 between the base computing device 324 and the base display device 120. The output provided across the communication link 928 may cause the base display device 120 to display a number or other graphic representing the current weight of the dumbbell 102. For example, in FIG. 1B, the base display device 120 displays "60" to indicate that the adjustable dumbbell currently weighs sixty pounds, which weight is due to the weight of weights plates 108 coupled to the handle assembly 105 and the weight of the empty handle assembly 105 itself. In some implementations, such as shown in FIG. 1A, the base display device 120 may display "0" when the dumbbell 102 is received in the base 104 and thus not in use. In some implementations, the communication link 928 between the base computing device 324 and the base display device 120 is a wired connection. In other implementations, this communication link 928 is wireless so as to support removal of the base display device 102 from the rest of the base 104.

The base computing device 324 may additionally be configured to output data to one or more computing devices that are external or separate from the base 104. In one respect, the base computing device 324 may be configured to output data for display on the adjustable dumbbell 102. In this regard, the adjustable dumbbell 102 may include an on-board computing device, referred to herein as a dumbbell computing device 932. The dumbbell computing device 932 may be generally configured to receive data transmitted from the base computing device 324 and to provide output to a user of the dumbbell system 100. In some implementations, the dumbbell computing device 932 may additionally be configured to receive data from other sources apart from the base computing device 324. For example, the dumbbell computing device 932 may additionally be configured to receive data from sensors or other devices on-board the dumbbell 102, such as accelerometers, weight sensors, and so on. In some implementations, the dumbbell computing device 932 may be configured to send and/or receive data to and from other computing devices, such as a user's mobile device.

Referring to FIGS. 1B-C, 2, 4, and 9, the base computing device 324 may be generally configured to communicate with the dumbbell computing device 932 across a wireless communication link 112. In this regard, the base computing device 324 may include a transceiver or other wireless communication interface 936 configured to send and receive wireless data. Similarly, the dumbbell computing device 932 may include a transceiver or other wireless communication interface 940 configured to send and/or receive wireless data. Each wireless interface 936, 940 may support a communication protocol that provides for the exchange of data using, for example, radio waves. In one implementation, the wireless interfaces 936, 940 may implement a communication protocol, such as Bluetooth, that is specifically adapted for exchanging data over short distances using short wavelength UHF radio waves.

The base computing device 324 may provide data across the wireless communication link 112 which may then be received and processed by the dumbbell computing device 932. In this regard, the dumbbell computing device 932 may include a processor 944 provided in association with a memory 948. The processor 944 may be configured to support the various operations of the dumbbell computing device 324, including processing data received from the base computing device 324. The processor 944 may communicate with the memory 948, which operates to store data and/or computer readable code that is executable by the processor 944. The dumbbell computing device 932 may additionally include a power source 946 such as a battery, power supply, or the like that provides electrical power to the electrical components of the dumbbell computing device 932, including the processor 944.

In one respect, the dumbbell computing device 932 may output visual information to the user through a dumbbell display device 116. In some cases, the dumbbell display device 116 may be a touch screen that additionally provides a mechanism for the user to input information. The dumbbell computing device 932 may be positioned such that the dumbbell display device 116 faces upward when the adjustable dumbbell 102 sits in the support base 104. Thus, when the adjustable dumbbell 102 sits in the support base 104, the dumbbell display device 116 will be in the direct line of sight of a user looking down on the adjustable dumbbell 102 from above.

The dumbbell computing device 932 may be mounted in one of two bridges 118 that are located on opposing lateral sides of the dumbbell 102. While it is possible to mount a dumbbell computing device 932 in each of the bridges 118, or elsewhere on the handle assembly 105, the dumbbell 102 will typically have one computing device 932 mounted in one bridge 118. The computing device 932 may be positioned within a cavity of the bridge 118 so as to protect the computing device 932 from damage. The top surface of the bridge 118, or a portion thereof, may be transparent so that the dumbbell display device 116 is visible. Alternatively, the dumbbell display device 116 may form at least a portion of the top side of the bridge 118, or may extend above the top surface of the bridge 118. In FIGS. 1A-2, the entire upward facing surface of the dumbbell computing device 932 includes the dumbbell display device 116 and is visible through the top surface of the bridge 118. The bridge 118, however, may not necessarily provide this same visibility. In some cases, the entire upward facing surface of the dumbbell computing device 932 may include an area other than the dumbbell display device 116. Here, the top surface of the bridge 118 may have a transparent region adjacent to the dumbbell display device 116 and an opaque region adjacent to the remainder of the dumbbell computing device 932. In this way, the dumbbell display device 116 is visible, while other components of the dumbbell computing device 932 are hidden from view.

In some cases, the dumbbell 102 features a dumbbell display device 116 that is removable from the remainder of the dumbbell 102. The dumbbell may include a circuit board having a dock in which the dumbbell display device 116 sits when the dumbbell display device 116 is physically connected to the remainder of the dumbbell. The dock may include a locking mechanism that holds the removable dumbbell display device 116 in place while the dumbbell is in use. The depth of the dock may correspond to a thickness of the dumbbell display device 116 so that the upward facing surface of the dumbbell display device 116 is flush with the top surface of the bridge 118 when the dumbbell display device 116 is seated in the dock. In this way, the upward facing surface of the dumbbell display device 116 forms a portion of the top surface of the bridge 118. The dumbbell computing device 932 and the dumbbell display device 116 may communicate over a wireless connection so that the dumbbell computing device 932 may continue to provide output through the dumbbell display device 116 when the dumbbell display device 116 is removed from the dock. When the dumbbell display device 116 is in the dock, the dumbbell computing device 932 and the dumbbell display device 116 may communicate over a wireless connection and/or a wired connection that may be provided through the dock.

The dumbbell computing device 932 may receive data from the base computing device 324 that generally indicates the current weight on the dumbbell 102. In some implementations, the dumbbell computing device 932 may receive data from the base computing device 324 that specifies the weight of the unused weight plates 108 remaining in the base 104. Here, the processor 944 may subtract the weight of the unused weight plates 108 remaining in the base 104, from the total weight of the adjustable dumbbell 102 with all weight plates 108 coupled thereto, to determine the current weight of the dumbbell 102. In other implementations, the base computing device 324 may provide data that directly specifies the current weight of the dumbbell 102. Once the current weight of the adjustable dumbbell 102 is received or determined, the processor 944 may provide output to the dumbbell display device 116. The output provided by the processor 944 may cause the dumbbell display device 116 to display a number or other graphic representing the current weight of the dumbbell 102. For example, in FIG. 1B, the dumbbell display device 116 displays "60" to indicate that the dumbbell 102 currently weighs sixty pounds.

Referring to FIGS. 2 and 9, the base computing device 324 may be additionally configured to output data for display on one or more wireless user devices 210*a-n*. For example, the base computing device 324 may provide output for display on a laptop computer, personal digital assistant, cell phone, smart phone, tablet computer, other mobile device, or the like. The base computing device 324 may transmit data that generally indicates the current weight of the dumbbell 102 across a communication link 212 to one or more user devices 210*a-n*. Here, the wireless communication interface 936 may be configured to support an appropriate communication protocol so as to allow the base computing device 324 to communicate with the user devices 210*a-n*. In some implementations, the base computing device 324 and the user devices 210*a-n* may communicate using a communication protocol, such as Bluetooth, that is specifically adapted for exchanging data over short distances using short wavelength radio waves. In other implementations, the base computing device 324 and the user devices 210*a-n* may communicate wirelessly across a local area network (LAN), a wide area network (WAN), or the like. Here, the base computing device may implement an appropriate communication protocol, which in some implementations may be Internet Protocol (IP). The base computing device 324 may also communicate with a wired user device 210*m* across a wired communication link 950. In this regard, the base communication device 324 may include a network interface 952 that implements an appropriate communication protocol, such as Ethernet, USB, or the like. A user device 210*a-n* may communicate with the base computing device 324, process the received data as needed, and provide output that causes a display device 214 to display a number or graphic that indicates the current weight of the dumbbell 102.

Wake-Up Signal

Figure 5:
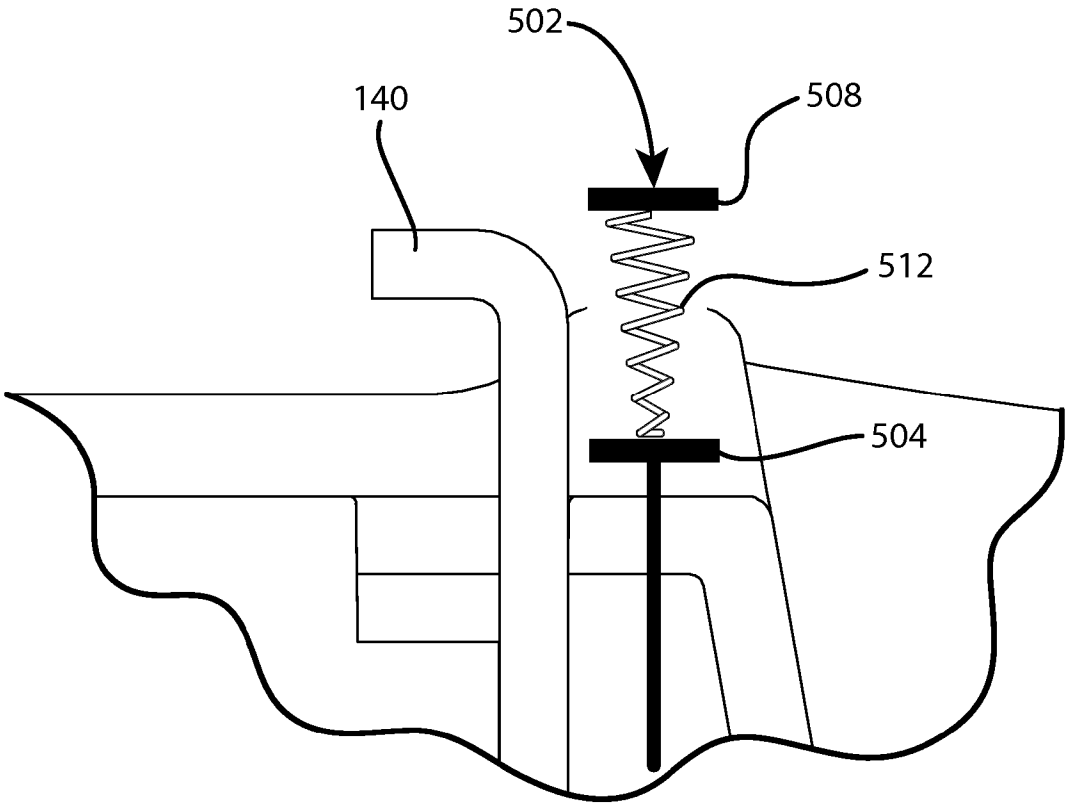
FIG. 5 is an enlarged view of a portion base shown in FIG. 4 that includes a mechanical trigger switch.

The adjustable dumbbell system 100 may include a switch or other trigger that is configured to wake-up or otherwise provide power to various components when the dumbbell 102 is removed from the base 104. For example, the system 100 may be configured to wake-up the sensing mechanism 908, the base computing device 324, wireless communication interface 936, and/or other components described herein. In this way, power savings may be achieved because various components may be provided power when power is needed and may be powered down when not in use. In the example configuration of FIGS. 4 and 5, the system 100 includes a mechanical wake-up switch 502 disposed on the base 104. The wake-up switch 502 may be configured to open or close depending on whether the dumbbell 102 is received in the base 104. For example, the switch 502 may close in the event that the dumbbell 102 is in the base 104. Conversely, the switch 502 may open in the event that the dumbbell 102 does not remain in the base 104. In the example configuration of FIGS. 4 and 5, the switch 502 may include first 504 and second 508 switch members that are maintained at a certain distance from each other by a spring 512 or other biasing member. The second switch member 508 may be arranged so as to be engaged by a portion of the dumbbell 102 when the dumbbell 102 is received the base 104. In this position, the dumbbell 102 may mechanically load the second switch member 508 and thereby trigger the switch 502 by driving the first 504 and second 508 switch members together against the action of the spring 512. In this position, the switch 502 may trigger a signal that wakes-up or otherwise provides power to various components, such as the sensing mechanism 908, the base computing device 324, and so on. In alternative embodiments, a wake-up switch may be disposed on different location on the base 104 or may be disposed on the dumbbell 102. A wake-up switch may include various triggering mechanism such as mechanical, electrical, and so on.

Example Operations

Figure 10:
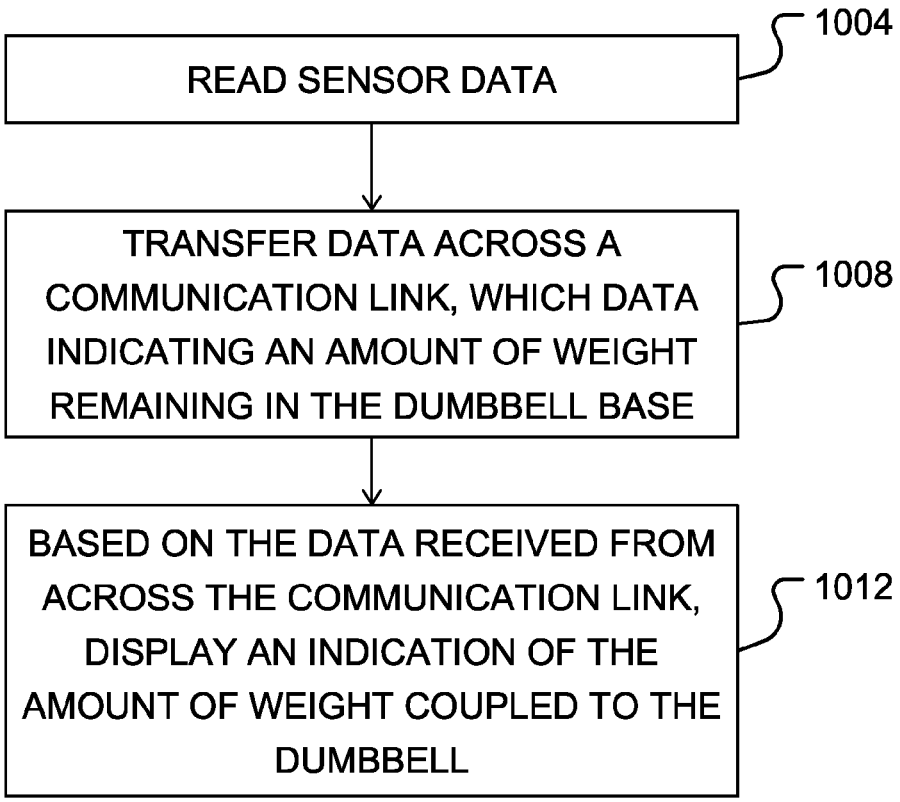
FIG. 10 is a flow chart that illustrates operations of one or more of the computing devices of FIG. 9.

FIG. 10 is flow chart that illustrates a method in accordance with the present disclosure. The method steps illustrated in FIG. 10 may be executed by one or more processors, such as the processor 916 associated with the base 324 or the processor 944 associated with the dumbbell 102. Initially, operation 1004, the processor 916 reads sensor data generated by the weight sensing mechanism 908. As mentioned, the sensing mechanism 908 may be associated with the base 104 and may sense the weight and/or presence of unused weight plates 108 remaining in the base 104 when the dumbbell 102 is removed from the base 104.

In operation 1008, the processor 916 transmits data that indicates the current weight of the dumbbell 102, which data is based on the characteristic of the unused weight plates 108 remaining in the base as detected by the sensing mechanism 908. Here, the processor 916 may transmit the data across one or more wired or wireless communication links. As mentioned, the processor 916 may transmit the data across a wireless communication link 112 to the dumbbell 102, across a wired 950 or wireless 212 communication link to an electronic device 210*a-m*, and/or across a wired or wireless communication link 928 to a base display device 120 that may be in physical contact with the base 104.

In operation 1012, an indication of the current weight of the dumbbell 102 is displayed based on the data received from across the communication link in operation 1008. In some instances, the processor 916 transmits data across the communication link that specifies the current weight coupled to the dumbbell 102. Here, the processor 916 determines the current weight of the dumbbell 102 through its own processing of sensor data. In other instances, the processor 916 transmits the raw sensor data across the communication link to be further processed by downstream processors, such as the processor 944 associated with dumbbell 102 or a processor associated with a user device 210*a-m*. Thus, in one example, the processor 944 associated with dumbbell 102 receives data across the wireless communication link 112 from the base 104, processes the data as needed, and displays an indication of the current weight of the dumbbell 102 on the dumbbell display device 116.

Figure 11:
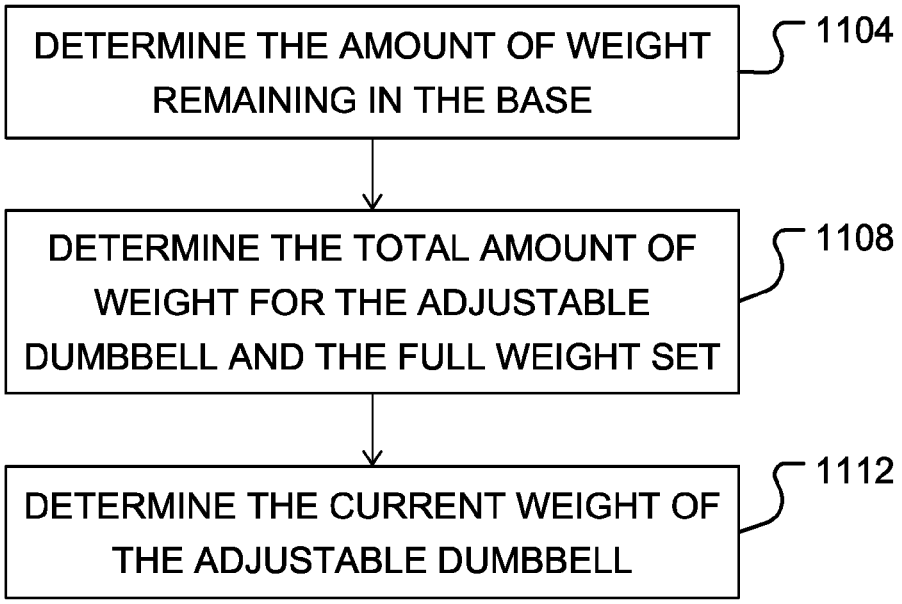
FIG. 11 is a flow chart that illustrates further operations of one or more of the computing devices of FIG. 9.

FIG. 11 is a flow chart that illustrates a method in accordance with the present disclosure. The method steps illustrated in FIG. 11 may be executed by one or more processors, such as the processor 916 associated with the base computing device 324 or the processor 944 associated with the dumbbell 102. As shown in FIG. 11, the processor 916, 944 may operate to process sensor data to determine the current weight of the dumbbell 102. In the case of the processor 916 associated with the base computing device 324, the processor 916 may receive the sensor data directly from the sensing mechanism 908. In the case of the processor 944 associated with the dumbbell 102, the processor 944 may receive the sensor data from across the wireless communication link 112.

Initially, in operation 1104, the processor 916, 944 processes the sensor data to determine an amount of weight for the unused weight plates 108 that remain in the base. Here, the processor 916, 944 may read an aggregate weight amount or add together individual weights amounts, as appropriate. In operation 1108, the processor 916, 944 determines the total amount of weight for dumbbell 102 with the full weight plate set 108 coupled thereto. Here, the processor 916, 944 determines the total amount based on prior weight measurements or by referencing stored data regarding the total weight amount. In operation 1112, the processor 916, 944 determines the current weight of the dumbbell 102 based on the amount of weight for the unused weight plates 108 that remain in the base 104. For example, the processor 916, 944 may subtract the weight amount determined in operation 1108 from the weight amount determined in operation 1104.

The technology described herein may be implemented as logical operations and/or modules in one or more systems. The logical operations may be implemented as a sequence of processor implemented steps executing in one or more computer systems and as interconnected machine or circuit modules within one or more computer systems. Likewise, the descriptions of various component modules may be provided in terms of operations executed or effected by the modules. The resulting implementation is a matter of choice, dependent on the performance requirements of the underlying system implementing the described technology. Accordingly, the logical operations making up the embodiments of the technology described herein are referred to variously as operations, steps, objects, or modules. Furthermore, it should be understood that logical operations may be performed in any order, unless explicitly claimed otherwise or a specific order is inherently necessitated by the claim language.

In some implementations, articles of manufacture are provided as computer program products that cause the instantiation of operations on a computer system to implement the invention. One implementation of a computer program product provides a non-transitory computer program storage medium readable by a computer system and encoding a computer program. It should further be understood that the described technology may be employed in special purpose devices independent of a personal computer.

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

The foregoing description has broad application. The discussion of any embodiment is meant only to be explanatory and is not intended to suggest that the scope of the disclosure, including the claims, is limited to these examples. In other words, while illustrative embodiments of the disclosure have been described in detail herein, the inventive concepts may be otherwise variously embodied and employed, and the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

The invention claimed is:

1. An adjustable dumbbell system, comprising:

an adjustable dumbbell including:

a handle assembly; and a plurality of weight plates, the plurality of weight plates and the handle assembly configured such that each of the plurality of weight plates can be selectively coupled to and decoupled from the handle assembly; and a base configured to support each of the plurality of weight plates, the base including a sensing mechanism comprising one or more load cells that sense a total aggregate weight of the plurality of weight plates that are supported on the base.

2. The adjustable dumbbell system of claim 1, further comprising a display device configured to display a number that is determined using the characteristic of the plurality of weights, and the characteristic includes the total aggregate weight of the plurality of weights.

3. The adjustable dumbbell system of claim 2, wherein the number represents a calculated weight of the adjustable dumbbell where the calculated weight of the adjustable dumbbell is calculated by adding a weight of a handle assembly to a difference between a total aggregate weight of all of the plurality of weight plates and a total aggregate weight of the plurality of weight plates that are supported on the base.

4. The adjustable dumbbell system of claim 2, wherein:

the display device is disposed on the handle assembly; and the base further comprises a wireless transmitter configured to transmit data to the handle assembly.

5. The adjustable dumbbell system of claim 4, further comprising:

a processor;

at least one memory operably linked to the processor, wherein the at least one memory comprises instructions, which when executed on the processor, cause the processor to:

receive sensor data generated by the sensing mechanism sensing the characteristic of the plurality of weight plates; and process the sensor data to determine a calculated weight of the adjustable dumbbell.

6. The adjustable dumbbell system of claim 5, wherein:

the processor is associated with the base;

the data that is transmitted by the wireless transmitter includes the calculated weight of the adjustable dumbbell; and the number represents the calculated weight.

7. The adjustable dumbbell system of claim 6, further comprising a second processor associated with the handle assembly, and the second processor causes the number to be displayed on the display device.

8. The adjustable dumbbell system of claim 5, wherein:

the processor is associated with the handle assembly; and the data transmitted by the wireless transmitter includes the sensor data.

9. The adjustable dumbbell system of claim 2, wherein the display device is disposed on the base.

10. The adjustable dumbbell system of claim 2, wherein the characteristic includes how many of the plurality of weight plates are supported on the base at the time of sensing by the sensing mechanism.

11. The adjustable dumbbell system of claim 2, further comprising a communication interface configured to transmit data to an electronic device associated with a user, which data is used by the electronic device to display a number that is determined using the characteristic.

12. The adjustable dumbbell system of claim 2, wherein the characteristic includes presence of weight plates on the base, and the sensing mechanism includes a plurality of sensors that each detect a presence of a particular weight plate of the plurality of weight plates in the even that the particular weight plate is supported on the base.

13. The adjustable dumbbell system of claim 12, wherein each sensor includes a first electrical contact that is disposed on the base and that engages a second contact disposed on the particular weight plate so as to signal that the particular weight plate is supported on the base.

14. The adjustable dumbbell system of claim 12, wherein each sensor includes a mechanical switch that closes when engaged by the particular weight plate so as to signal that the particular weight plate is supported on the base.

15. The adjustable dumbbell system of claim 1, further comprising a switch that is configured to provide power to at least the sensing mechanism in response to the handle assembly being removed from the base.

16. An adjustable dumbbell system, comprising:

an adjustable dumbbell including:

a handle assembly; and a plurality of weight plates, the plurality of weight plates and the handle assembly configured such that each of the plurality of weight plates can be selectively coupled to and decoupled from the handle assembly; and a base configured to support each of the plurality of weight plates, the base including a sensing mechanism configured to sense a characteristic of the plurality of weight plates where the characteristic depends upon which of the plurality of weight plates are supported by the base, wherein the characteristic is weights of weight plates supported on the base, and the sensing mechanism includes a plurality of load cells that each sense a weight of a particular weight plate of the plurality of weight plates in the event that the particular weight plate is supported on the base.

17. The adjustable dumbbell system of claim 16, further comprising a display device configured to display a number that is determined using the characteristic.

18. The adjustable dumbbell system of claim 17, wherein the number represents a calculated weight of the adjustable dumbbell where the calculated weight of the adjustable dumbbell is calculated by adding a weight of the handle assembly to a difference between a total aggregate weight of all of the plurality of weight plates and a total aggregate weight of the plurality of weight plates that are supported on the base.

19. The adjustable dumbbell system of claim 18, wherein:

the display device is disposed on the handle assembly; and the base further comprises a wireless transmitter configured to transmit data to the handle assembly.

20. The adjustable dumbbell system of claim 19, further comprising:

a processor;

at least one memory operably linked to the processor, wherein the at least one memory comprises instructions, which when executed on the processor, cause the processor to:

receive sensor data generated by the sensing mechanism sensing the characteristic of the plurality of weight plates; and process the sensor data to determine a calculated weight of the adjustable dumbbell.

21. The adjustable dumbbell system of claim 20, wherein:

the processor is associated with the base;

the data that is transmitted by the wireless transmitter includes the calculated weight of the adjustable dumbbell; and the number represents the calculated weight.

22. The adjustable dumbbell system of claim 21, further comprising a second processor associated with the handle assembly, and the second processor causes the number to be displayed on the display device.

23. The adjustable dumbbell system of claim 20, wherein:

the processor is associated with the handle assembly; and the data transmitted by the wireless transmitter includes the sensor data.

24. The adjustable dumbbell system of claim 19, wherein the display device is disposed on the base.

25. The adjustable dumbbell system of claim 18, wherein the characteristic includes how many of the plurality of weight plates are supported on the base at the time of sensing by the sensing mechanism.

26. The adjustable dumbbell system of claim 17, further comprising a communication interface configured to transmit data to an electronic device associated with a user, which data is used by the electronic device to display a number that is determined using the characteristic.

27. The adjustable dumbbell system of claim 16, further comprising a switch that is configured to provide power to at least the sensing mechanism in response to the handle assembly being removed from the base.

* * * * *